US012799548B2

(12) United States Patent
Bellmann

(10) Patent No.: US 12,799,548 B2
(45) Date of Patent: Nov. 17, 2026

(54) METHOD FOR TREATING STEEL MILL SLAG

(71) Applicant: OCS 2 UG (HAFTUNGSBESCHRÄNKT), Rötha ot Espenhain (DE)

(72) Inventor: Günther Bellmann, Leipzig (DE)

(73) Assignee: OCS 2 UG (HAFTUNGSBESCHRÄNKT), Rötha ot Espenhain (DE)

( * ) Notice: Subject to any disclaimer, the term of this patent is extended or adjusted under 35 U.S.C. 154(b) by 359 days.

(21) Appl. No.: 18/690,980

(22) PCT Filed: Sep. 13, 2021

(86) PCT No.: PCT/EP2021/075059
§ 371 (c)(1),
(2) Date: Mar. 11, 2024

(87) PCT Pub. No.: WO2023/036441
PCT Pub. Date: Mar. 16, 2023

(65) Prior Publication Data

US 2025/0146091 A1 May 8, 2025

(51) Int. Cl.
*C21B 3/04* (2006.01)
*C22B 7/04* (2006.01)

(52) U.S. Cl.
CPC ..... *C21B 3/04* (2013.01); *C22B 7/04* (2013.01); *C21B 2200/00* (2013.01); *C21B 2400/02* (2018.08)

(58) Field of Classification Search
CPC ..... C21B 3/04; C21B 2400/02; C22B 7/04; C22B 3/22; C22B 3/44
See application file for complete search history.

(56) References Cited

U.S. PATENT DOCUMENTS

2005/0036932 A1 2/2005 Takahashi et al.
2012/0121488 A1 5/2012 Comrie

FOREIGN PATENT DOCUMENTS

JP H05163047 A 6/1993

OTHER PUBLICATIONS

International Search Report of the International Searching Authority issued in PCT/EP2021/075059, mailed May 30, 2022; ISA/EP.

*Primary Examiner* — Jessee R Roe
(74) *Attorney, Agent, or Firm* — Harness, Dickey & Pierce, P.L.C.

(57) ABSTRACT

The method according to the invention for treating steel mill slag includes the steps of A) providing steel mill slag in solid form having a fineness such that the steel mill slag has a specific surface area according to BET of 0.1 $m^2/g$ or more; step B) treating the steel mill slag by heating it to a temperature of at least 800° Celsius, while adding oxidizing agents and auxiliary agents; and step C) separating iron(III) oxide and iron(II,III) oxide out of the treated steel mill slag.

19 Claims, 1 Drawing Sheet

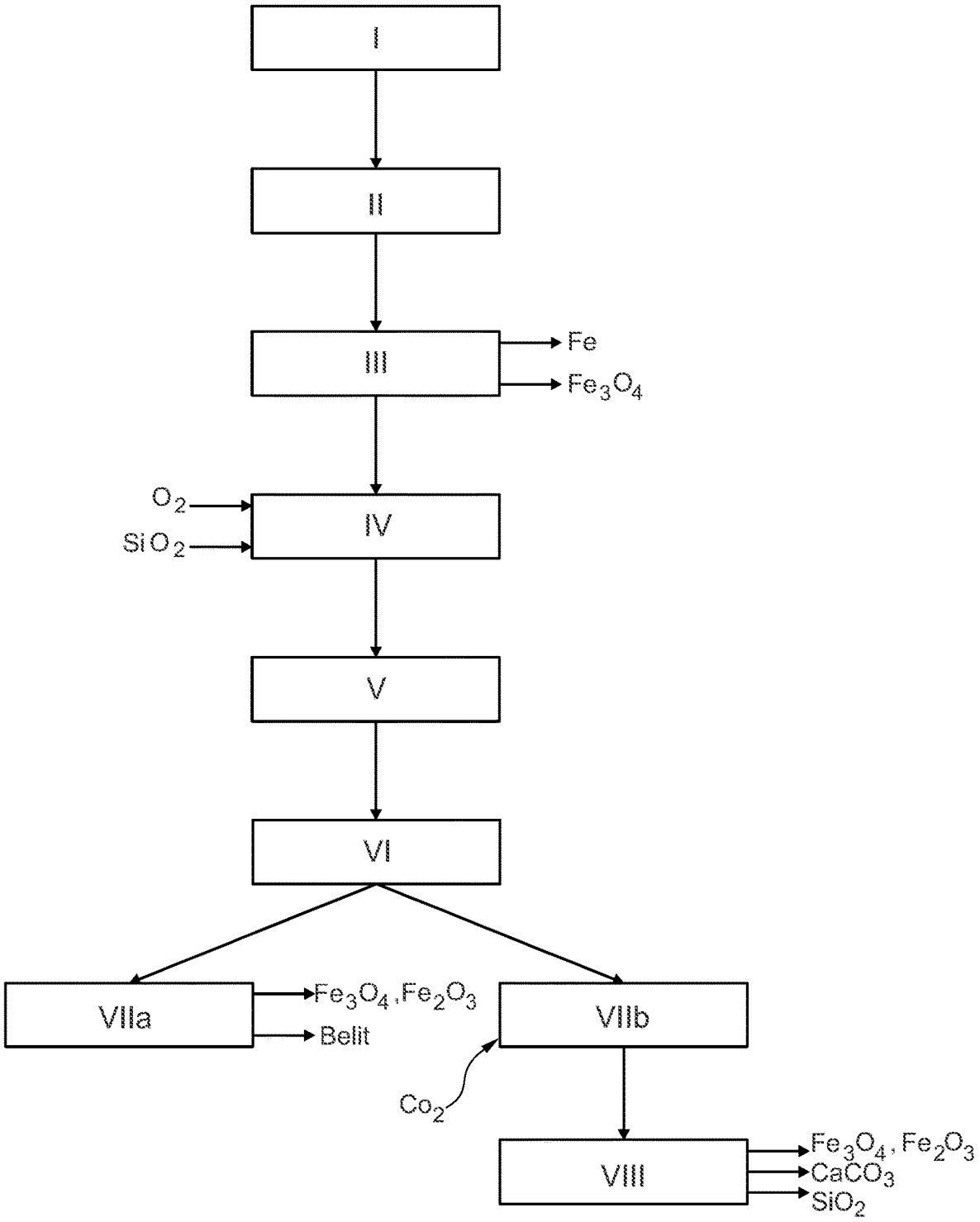
I
II
III
Fe
$Fe_3O_4$
$O_2$
$SiO_2$
IV
V
VI
VIIa
$Fe_3O_4$, $Fe_2O_3$
Belit
VIIb
$Co_2$
VIII
$Fe_3O_4$, $Fe_2O_3$
$CaCO_3$
$SiO_2$

METHOD FOR TREATING STEEL MILL SLAG

CROSS-REFERENCE TO RELATED APPLICATIONS

This application is a 371 U.S. National Phase of International Application No. PCT/EP2021/075059, filed on Sep. 13, 2021. The entire disclosure of the above application is incorporated herein by reference.

The invention relates to a method for treating steel mill slag.

The production of pig iron and steel produces various by-products. These have different qualities and this results in different utilization options. Blast furnace slag is produced during the production of pig iron in the blast furnace. In quenched and ground form, this is known as granulated blast furnace slag and is used as an additional main component in the cement production process. One property of granulated blast furnace slag is its very low iron content of well below 5%. For this reason, separation of the iron content from the blast furnace slag is not carried out in industrial practice.

During further processing of the pig iron in the steel mill, the carbon content is reduced and further chemical changes occur here. In order to separate out secondary components such as $SiO_2$, manganese or phosphorus, limestone is added again during steel production, as in pig iron production. The limestone essentially consists of $CaCO_3$ and dissociates into CaO and $CO_2$. The carbon dioxide is released and contributes to the $CO_2$ emissions from the steel production process. Alternatively, the limestone can also be processed into quicklime by thermal treatment before being added to the pig iron and the quicklime can be added to the pig iron instead of the limestone. In this case, the $CO_2$ emissions are generated in an upstream process, but can be attributed to steel production. In the following, only the case of limestone addition to pig iron is considered, but the illustration includes the use of quicklime instead of limestone after thermal pre-treatment of the limestone. The CaO from the addition of limestone and/or quicklime serves to bind the secondary components of the pig iron and, together with these and other additions, forms the so-called steel mill slag.

The steel mill slag can be separated from the liquid iron or steel like blast furnace slag due to the difference in density in the liquid state. In contrast to blast furnace slag, steel mill slag contains significant amounts of iron. The iron is present in different oxidation states and compounds. Steel mill slag usually contains metallic iron (Fe), wüstite (iron(II) oxide, FeO), haematite (iron(III) oxide, $Fe_2O_3$), magnetite (iron(II, III) oxide, $Fe_3O_4$), srebrodolskite ($Ca_2Fe_2O_5$, $C_2F$), tetracalcium aluminate ferrite (brownmillerite, $Ca_2(Al,Fe)_2O_5$, $C_4AF$) and other iron-containing compounds. The steel mill slag may also contain amorphous, ferrous components. The compounds mentioned and all other phases described below do not generally occur in chemically pure form, but contain a large number of chemical elements as impurities in varying concentrations. The total iron content of steel mill slag is around 30% if the iron content is given as $Fe_2O_3$ regardless of the actual oxidation state of the individual components. Separating such high iron contents and returning the iron to the metallurgical process is desirable from an economic point of view and can also increase the quality of a product obtained from steel mill slag. Until now, steel mill slag has usually only been landfilled or used for secondary uses such as road construction.

It is therefore desirable to be able to recover the iron content from the steel mill slag. Ideally, it should be possible to carry out this process while the steel mill slag is still liquid as well as when it has cooled and solidified.

Steel mill slag also includes converter slag or LD slag, which is produced as slag as part of the Linz-Donawitz process. Alternatively, it is referred to as BOF slag (basic oxidation furnace), especially in English-speaking countries. Steel mill slag also includes electric arc furnace slag, which is also known as EAF slag, stainless steel slag, which is also known as SSS, and secondary metallurgy slag, which is also known as SMS. Steel mill slags have an average chemical composition, which varies depending on the steel mill, of around: 40% CaO, 30% $Fe_2O_3$, 10% $SiO_2$, 5% MgO, 3% $Al_2O_3$, 3% MnO, as well as other elements or oxides with lower concentrations. From a mineralogical point of view, steel mill slag contains approximately: 20 to 30% belite, 15 to 30% srebrodolskite, about 10% wüstite, up to 10% free lime, up to 5% magnetite, up to 5% alite, as well as other crystalline compounds and up to 50% amorphous components.

The object of the invention is therefore to provide a method for treating steel mill slag with which a large proportion of the iron present can be recovered.

According to the invention, this object is achieved by a method for treating steel mill slag having the features of claim 1.

Further advantageous embodiments are provided in the dependent claims, in the further description and in the exemplary embodiment.

According to claim 1, it is provided that several steps are carried out in the method according to the invention. These steps do not necessarily have to be carried out in the order described here.

The method according to the invention includes the step A) of providing steel mill slag which, when solidified, includes at least iron(II) oxide (wüstite). If solidified and steel mill slag that is still liquid is not used, it should be so fine that it has a specific surface area of 0.1 $m^2/g$ according to BET, preferably of 0.5 $m^2/g$, in particular of 1.0 $m^2/g$ or more. It can be provided in solid form or still molten from a previous process. Like most of the other substances listed here, the iron(II) oxide is not usually present in its pure chemical form but is contaminated, for example with foreign ions or fused with other contents. It can be detected by means of XRD analysis, for example.

In a step B), the steel mill slag is treated at a temperature of at least 600° C., preferably to at least 800° C., in particular to at least 1,000° C., while adding oxidizing agents and auxiliary agents. Depending on the state of the slag after step A), heating may or may not be necessary therefor.

The oxidizing agents oxidize the iron(II) oxide present partially or completely to iron(III) oxide and/or iron(II,III) oxide. At the same time, other compounds are also partially or completely oxidized. The auxiliary agents also form a bond with the calcium present in the steel mill slag. This was previously bound in calcium-iron compounds or other compounds and during this process iron(III) oxide and/or iron (II,III) oxide is released. Furthermore, the total amount of calcium silicates (alite, belite, rankinite, wollastonite) present in the treated steel mill slag, in particular belite, is increased.

In a further step C), iron(III) oxide and/or iron(II,III) oxide can be separated from the treated steel mill slag.

Iron (II) oxide is also known as FeO or wüstite and is essentially formed during the lowering of the carbon content in steel production. Like many other phases, wüstite can have very high concentrations of impurity oxides. Iron (III) oxide is also known as $Fe_2O_3$ and alternatively as haematite, which is the most common natural modification of iron(III) oxide. Iron (III, II) oxide is also known as $Fe_3O_4$ and is found in nature in the form of magnetite.

Belite is also known as dicalcium silicate and has the chemical formula 2 $CaO \cdot SiO_2$, or $C_2S$ in cement chemical shorthand notation.

A basic concept of the invention can be seen in proposing a way to treat iron(II) oxide in the steel mill slag such, in this case to oxidize it to iron(III) oxide. The reaction equation on which this is based is as follows:

$$2FeO+\tfrac{1}{2}O_2 \rightarrow Fe_2O_3 \quad (1)$$

Instead of $Fe_2O_3$, $Fe_3O_4$ or a mixture of $Fe_2O_3$ and $Fe_3O_4$ can also be formed.

$$3FeO+\tfrac{1}{2}O_2 \rightarrow Fe_3O_4 \quad (2)$$

A further oxidation of iron(II, III) oxide, which is also present, also produces iron(III) oxide:

$$2Fe_3O_4+\tfrac{1}{2}O2 \leftrightarrow 3Fe_2O_3 \quad (3)$$

Treating or, if necessary, heating the steel mill slag at a temperature of at least 600° C., preferably at least 800° C., and in particular at least 1,000° C., has proven to be sufficient. In this state, the steel mill slag has not yet melted and no superfluous energy needs to be invested, as the processes described also take place at temperatures of 600° C. and above. In the simplest embodiment, oxygen from the air can be used here as the oxidizing agent. In principle, however, other oxidizing agents such as $H_2O_2$ and other peroxides, ozone or $N_2O$ can also be added to the steel mill slag.

According to the invention, additional auxiliary agents are added for a further reaction of the steel mill slag, in order to provide a reaction partner for bound calcium from calcium-iron compounds, such as srebrodolskite or other compounds, so that the iron is released. The underlying reaction can be described as follows, for example $$2CaO \cdot Fe_2O_3+SiO_2 \rightarrow 2CaO \cdot SiO_2+Fe_2O_3 \quad (4)$$

or in cement chemical shorthand notation $$C_2F+S \rightarrow C_2S+F$$

Thus, this produces iron(III) oxide or iron(II,III) oxide and belite, wherein the products can be processed and separated in the further method.

According to step C) of the method according to the invention, the iron contained in the steel mill slag treated in this way can be separated as iron(III) oxide and/or iron(II, III) oxide, since the iron is no longer bound in calcium-iron compounds or other complex compounds, but is present as an independent phase such as iron(III) oxide and/or iron(II, III) oxide in the structure. However, the iron oxide particles are closely intergrown with other phases such as belite.

The addition of auxiliary agents, such as $SiO_2$, and oxidizing agents, such as oxygen, can also take place in the liquid state as long as the slag has not yet solidified when it is transferred in liquid form in step A). Iron oxide formation can also be achieved in this way.

According to the invention, it is provided in step A) that the steel mill slag is provided in solid form and has a fineness corresponding to a specific surface area according to BET of 0.1 $m^2/g$, preferably of 0.5 $m^2/g$, in particular of 1.0 $m^2/g$ or more. The crushing required for this can be carried out, for example, by an appropriate grinding unit. However, it is also possible, for example, to granulate still liquid steel mill slag as part of a granulation process and thus make it available in a sufficient fineness.

It is also preferable if, in a step D), the treated steel mill slag, which is at least 600° C. hot, is heated in a reducing atmosphere, in particular by adding reducing agents, so that it is reduced again. In this process, iron(III) oxide is reduced to iron(II, III) oxide. Advantageously, this step is carried out after step B) and before step C).

The underlying reaction has already been described above under (3).

The oxidation in step B) also oxidizes the iron(II,III) oxide to iron(III) oxide, depending on the oxidizing agent present and its quantity. If magnetic separation of the iron from the treated steel mill slag is desired, it is provided to reduce the iron(III) oxide completely or almost completely to iron(II, III) oxide, as this can be better separated by means of magnetic separation. It is preferable here if the reduction is carried out without cooling the treated steel mill slag after step B) in order to be able to dispense with heating. The reduction can be carried out in a reducing atmosphere, such as air containing CO. However, reducing agents such as organic fuels, Fe or FeO can also be added additionally or alternatively. The thermal treatment can be carried out in an electrically heated rotary kiln, for example, which contains an oxidizing atmosphere for step B) in the upper area and a reducing atmosphere for step D) in the lower area.

Step D) can be omitted if only incomplete oxidation with the formation of magnetite instead of haematite occurred in step B) or if a formation of magnetite is not desired.

For further processing, in particular in preparation for step C), it is preferable to cool, solidify and crush the warm, treated steel mill slag after the optional step D) or directly after step B) to a fineness that corresponds to a specific surface area according to BET of 0.1 $m^2/g$, preferably of 0.5 $m^2/g$, in particular of 1.0 $m^2/g$ or more. This can be done, for example, by a mill, in particular a vertical mill.

In principle, various separation mechanisms can be used to separate the iron(III) oxide and/or the iron(II,III) oxide from the treated steel mill slag. Advantageously, the separation can be carried out by magnetic separation based on magnetic properties, density separation or by flotation. In the case of density separation, for example, it makes sense to carry this out together with the previously described crushing of the treated steel mill slag, as methods are known in which density separation can be carried out simultaneously with a crushing process.

For separation, the material to be separated can also be transferred into a suspension, in particular using water. A better and more efficient result can often be achieved with wet magnetic separation than with dry magnetic separation.

Flotation is a physical, chemical separation process for fine-grained solids in which separation can take place due to the different surface wettability of the particles. For example, a suspension in water can be used and a gas can be injected into it. Depending on the surface properties of the particles present, auxiliary agents (collectors) added can adsorb to the surface of the particles and temporarily bind the introduced gas bubbles, causing the particles to rise. The adsorption of the added excipients is phase-sensitive and separation takes place in this way.

Belite and other calcium-containing compounds, such as calcium silicates, are present in the treated steel mill slag, which are often intergrown with the iron(III) oxide and/or the iron(II,III) oxide. On the one hand, these can be broken up in a mill using the fine crushing process described above. On the other hand, as an alternative or additional option, in a step E), it is proposed to treat the treated steel mill slag with $CO_2$ in order to convert belite (2 $CaO \cdot SiO_2$) and, if present, other calcium silicates such as alite, wollastonite and/or rankinite completely or partially into calcium carbonate ($CaCO_3$) and silicon dioxide ($SiO_2$) or other reaction products such as dolomite or magnesium carbonate. In this way, the close intergrowth between iron oxide and belite can be largely eliminated, making separation easier. This method step can be carried out in a suspension, for example, so that the previous step of separation by flotation can be combined with this step. When the treated steel mill slag is mixed with a gas containing $CO_2$, such as air, the following reaction takes place:

$$2CaO\cdot SiO_2+2CO_2\rightarrow 2CaCO_3+SiO_2 \quad (5)$$

As a rule, this does not produce pure $SiO_2$, but a $SiO_2$-rich residual material.

In detail, step E) can be carried out in an aqueous suspension of the treated, cooled, solidified and crushed steel mill slag. In this case, a gas containing $CO_2$ can be injected. In principle, however, other contact options or ways of introducing $CO_2$ are also possible.

When the belite is broken up by the chemical reaction according to equation (5), the iron(III) oxides and/or iron(II, III) oxides fused with it are simultaneously released so that they can be separated.

As already described, the $CaCO_3$ can also be separated in this context, for example in the form of $CaCO_3$-rich material with a proportion of at least 70% by mass, preferably at least 80% by mass, even more preferably at least 90% by mass $CaCO_3$, by means of flotation or other methods following or simultaneously with the treatment of the treated steel mill slag with $CO_2$. In principle, the separation of a specific material within the scope of the invention can also be carried out in such a way that other materials are separated by parallel processes so that only the desired material remains.

It is preferred if the gas, which contains $CO_2$, originates from steel production. This occurs during steel production as a waste product, as described above, and has a negative impact on the carbon footprint of the steel production process. By using the method described here, the $CO_2$ can be bound and thus does not escape into the environment. This applies in a similar way when quicklime is used for steel production, provided that quicklime production is included in the overall process. This results in a significantly improved carbon footprint.

In this context, the $CaCO_3$-rich material obtained can in turn be used in steel production or pig iron production for further utilization. As already described, $CaCO_3$ is used in steel production to separate out secondary components such as $SiO_2$. By utilizing the recovered $CaCO_3$ in the steel production process, the consumption of limestone, which essentially consists of $CaCO_3$, is significantly reduced, which in turn reduces the costs of steel production. Both the $CaCO_3$-rich residue and the unseparated mixture of $CaCO_3$ and $SiO_2$ can also be used in the cement production process as a raw meal component or as an additional main component.

In a similar way, the $SiO_2$-rich residual material recovered, for example with a proportion of at least 70% by mass, preferably at least 80% by mass, even more preferably at least 90% by mass $SiO_2$, can be further utilized. For example, it can be used as a pozzolan in the cement production process.

The recovered iron(III) oxide and/or iron(II, III) oxide can also be fed to upstream processes, in this case to steel production or blast furnace processes for further utilization. The same applies to other recovered iron oxides and metallic iron. This is not pure material either. This is particularly suitable as the steel mill slag already comes from these processes and is therefore often in close proximity.

When used in steel mills, the oxygen requirement can also be reduced during refining.

In a similar way to the $SiO_2$-rich residual material, the belite-containing material ($2\ CaO\cdot SiO_2$), for example with a proportion of at least 40% by mass belite, preferably at least 50% by mass, even more preferably at least 60% by mass, can also be fed into the cement production process. Belite is a component of clinker and would otherwise have to be produced there using energy-intensive calcination processes. In a similar way, a material rich in other calcium silicates such as alite, wollastonite and/or rankinite can also be added to the cement production process, wherein the total proportion of calcium silicates is at least 40% by mass, preferably at least 50% by mass, more preferably at least 60% by mass.

In principle, metallic iron and/or iron(II,III) oxide and other compounds can already be separated from the steel mill slag before step A), for example by means of magnetic separation, so that the energy that has to be used to heat the steel mill slag is already significantly reduced. This also reduces the effort required for subsequent iron separation.

The invention is explained in more detail below by means of an exemplary embodiment and a schematic flow diagram. In this drawing:

FIG. 1 shows a schematic flow diagram of the method according to the invention.

FIG. 1 shows a schematic flow diagram of a possible embodiment of the method according to the invention. This combines the possible steps described above. In principle, it is also possible to omit here individual steps.

In step I, steel mill slag is provided. This has various ferrous compounds in its solidified state, such as metallic iron (Fe), wüstite (iron(II) oxide, FeO), haematite (iron(III) oxide, $Fe_2O_3$), magnetite (iron(II,III) oxide, $Fe_3O_4$), srebrodolskite ($Ca_2Fe_2O5$, $C_2F$), tetracalcium aluminate ferrite (brownmillerite, $Ca_2(Al,Fe)_2O_5$, $C_4AF$). Converted to iron (III) oxide, the average iron content is around 30%.

The steel mill slag provided in step I is then ground in step II to a sufficient fineness so that it has, for example, a specific area surface according to BET of 0.1 $m^2/g$, preferably 0.5 $m^2/g$, in particular 1.0 $m^2/g$ or more. This grinding can be carried out using a vertical roller mill, for example. Alternatively, the steel mill slag can already be present as granulate before step I, so that it no longer needs to be crushed further and step II can be omitted.

In a step III, elemental iron (Fe) and iron(II,III) oxide ($Fe_3O_4$) can already be separated from the ground or crushed steel mill slag by means of magnetic separation. These two components have good ferromagnetic properties, such that magnetic separation is possible. This is supported by the presence in the described fineness, as the materials are usually no longer intergrown with other phases. This step is also optional.

The steel mill slag is then heated in step IV. Instead of the method steps described so far, liquid slag from upstream processes can also be used. The treatment, wherein solidified slag is also heated, takes place in a normal atmosphere, as with ambient air. Additional, even more ambient air can be injected. It is essential here that an oxidation reaction takes place in the steel mill slag as described in equation (1).

$$2FeO+\tfrac{1}{2}O_2\rightarrow Fe_2O_3 \quad (1)$$

Alternatively, $Fe_3O_4$ can be obtained:

$$3FeO+\tfrac{1}{2}O_2\rightarrow Fe_3O_4 \quad (2)$$

Here, the $O_2$ present in the air can serve as an oxidizing agent. However, alternatively or additionally, the steel mill slag can also be mixed or treated with other oxidizing agents such as $H_2O_2$ and other peroxides, ozone, $N_2O$ or pure oxygen.

In addition, additives are added, for example in the form of $SiO_2$. This addition can also take place in step II, so that homogenization takes place during grinding if the slag is solid.

When $SiO_2$ is added to the slag, the reactions described in equation (4) take place:

$$2CaO \cdot Fe_2O_3 + SiO_2 \rightarrow 2CaO \cdot SiO_2 + Fe_2O_3 \quad (4)$$

The $SiO_2$ source can be used rock flour, for example from sandstone or quartzite, coal fly ash, sand, silica dust, pozzolana and/or fired clay, as well as the $SiO_2$-rich residue from this method.

For separation using a magnetic separator, it is advantageous if the iron(III) oxide is converted into iron(II,III) oxide, as this enables better separation using a magnetic separator. Therefore, without additional cooling, the heated steel mill slag can be exposed to a reducing atmosphere in step V, so that a conversion of the iron(III) oxide to iron(II, III) oxide takes place, as described in equation (3). It should be noted here that this reaction has already taken place as an oxidation in the reverse direction in step IV and iron(II,III) oxide has been oxidized to iron(III) oxide. Accordingly, this step can be omitted if only enough oxidizing agent has been added to the slag to produce mainly magnetite and little or no haematite.

$$2Fe_3O_4 + \tfrac{1}{2}O_2 \leftrightarrow 3Fe_2O_3 \quad (3)$$

The steel mill slag is then cooled down again in a step VI, wherein the heat energy present can be recovered.

Iron (II,III) oxide and, if still present, iron(III) oxide can then be separated from the cooled slag in step VIIa, for example by using a magnetic separator or density separation. For this purpose, it is advantageous if the cooled slag is ground again so that belite components intergrown with iron(II,III) oxide are separated.

The remaining slag, which has a high belite content, can then be supplied to the cement industry for use as an additional main component or as a raw meal component.

Alternatively or additionally to this, the slag can be further treated in step VIIb, in which water is added to the slag to produce an aqueous suspension. The treated slag can also be finely ground for this purpose, but this is not absolutely necessary. Air or another gas containing $CO_2$, for example exhaust air from steel production, can be injected into the suspension, causing the belite and/or other calcium silicates such as alite, wollastonite and/or rankinite to decompose into calcium carbonate ($CaCO_3$) and silicon dioxide ($SiO_2$) or other reaction products. This separates the belite from intergrown iron oxides so that they can be separated more easily later. The reaction on which this is based is described in equation (5).

$$2CaO \cdot SiO_2 + 2CO_2 \rightarrow 2CaCO_3 + SiO_2 \quad (5)$$

The iron oxides formerly intergrown with other phases can be further separated in step VIII by means of flotation, for example, wherein this step can also be carried out simultaneously with step VIIb. The $SiO_2$-rich residual material and the calcium carbonate ($CaCO_3$) can also be separated in this process.

The recovered iron, both in metallic form (Fe) and in the form of iron(III) or iron(II,III) oxides, can then be reused in steel production process. Similarly, the calcium carbonate ($CaCO_3$) can also be fed into the steel production process, which reduces the amount of limestone required there accordingly.

As described above, the recovered belite can be used directly in the cement production process. The same also applies to the $SiO_2$-rich residue, which can also be reused in step II. The $CaCO_3$-rich residue and the unseparated mixture containing $SiO_2$ and $CaCO_3$ can also be used in the cement production process as a raw meal component and/or as an alternative main component.

The $CO_2$ required in step VIIb preferably comes from the steel production process and can thus significantly improve the environmental impact with regard to $CO_2$ production in the steel production process, as it can be bound in this process according to the invention.

The method according to the invention is explained in more detail below using a specific example.

A steel mill slag with the following composition was used for the investigations, which was determined using quantitative X-ray diffraction: 17% $C_2F$, 45% $\beta$-$C_2S$, 2% $\gamma$-$C_2S$, 5% CaO, 3% metallic iron, 4% portlandite, 24% wüstite and 1% magnetite. The figures are given in percentage by mass and refer to the crystalline components. Amorphous phases are also included, but these have not been quantified. This also applies to the analysis results below, which were also determined using quantitative X-ray diffraction.

The material was ground in a vibrating disc mill and then in a McCrone mill with the addition of water. The ferromagnetic components were then separated using a permanent magnet in an aqueous suspension and the sample was subsequently dried. The amount separated was 5% of the material used. The deposited product consisted of 6% $C_2F$, 4% $\beta$-$C_2S$, 73% metallic iron, 7% magnetite and 10% wüstite. It is therefore an iron-rich material with low impurities of CaO, $SiO_2$ and other oxides, which can be used for the production of pig iron and steel due to its composition.

The material remaining after magnetic separation was composed as follows: 15% $C_2F$, 46% $\beta$-$C_2S$, 4% $\gamma$-$C_2S$, 3% calcite, 1% metallic iron, 4% portlandite, 25% wüstite and 2% magnetite. This material still contains large amounts of iron, but not as metallic iron. The iron is bound in various mineral phases, in particular as $C_2F$ and wüstite. Neither of the two phases are ferromagnetic and can therefore hardly be separated with a magnetic separator.

To enable separation of these iron quantities, the material was mixed with an auxiliary agent ($SiO_2$ ultrafine flour Sikron SF 6000) in a ratio of $SiO_2$:modified steel mill slag of 1:14. The $SiO_2$ fine material consisted entirely of cristobalite. The two substances were homogenized by grinding them together in the vibratory disc mill for 2 minutes. Part of the mixture was then fired for 4 hours at 1,100° C. in a muffle furnace. The material was in an open crucible and was therefore in constant contact with the atmosphere and the oxygen it contained.

Oxygen uptake and chemical reactions occurred during the high-temperature treatment. After cooling, the phase composition was determined by using quantitative X-ray diffraction. This amounted to 6% $C_2F$, 48% $\beta$-$C_2S$, 4% $\gamma$-$C_2S$, 9% $C_3A$, 9% rankinite, 3% wüstite and 22% magnetite. As a result, extensive oxidation of the wustite to magnetite occurred during the thermal treatment, as the wüstite concentration fell from 23% to 3% and the magnetite concentration rose from 2% to 22%.

At the same time, the $C_2F$ was converted into $C_2S$, consuming cristobalite and releasing iron oxide, which also contributed to an increase in the magnetite concentration in the in the majority of the iron being bound in a phase that can be separated by magnetic separation. Obviously, the oxygen supply was not high enough for further oxidation to haematite. Furthermore, the concentration of calcium silicates in the sample increased, as the belite concentration rose from 46% to 52% and the rankinite concentration increased from 0% to 9%. sample. Thus, the thermal treatment after the addition of the additives has resulted After thermal treatment, a large proportion of the iron is bound as magnetite and can be separated. To facilitate the separation process, the material was ground again in a McCrone mill with the addition of water for 5 minutes and then treated with $CO_2$. For this purpose, 5 grams of the treated steel mill slag was added to 400 ml of water and stirred continuously while simultaneously introducing $CO_2$ into the beaker containing the sample. Phase separation was facilitated by the use of ultrasound and the addition of nucleating agents ($CaCO_3$, Merck). After a treatment period of 3 hours, the sample was filtered, dried and analyzed. After the reaction of the modified steel mill slag with carbon dioxide, the material no longer contained any belite and only $C_2F$, rankinite, magnetite and calcite could be detected as crystalline compounds. Other reaction products such as amorphous $SiO_2$, magnesium carbonate and dolomite were also formed.

The magnetite was separated using a permanent magnet in an aqueous suspension. Flotation was then carried out to separate calcium carbonate and $SiO_2$. Dodecylamine was used as a collector and starch was used as a depressor, causing the calcium carbonate to rise with the introduced air bubbles and the $SiO_2$ and other phases to sink. This meant that the calcium carbonate could be removed from the top and the $SiO_2$-rich residue from the bottom, and after treatment they were separated and could be dried.

The method according to the invention can thus be used to separate iron from steel mill slag in a simple and efficient manner and even the other components can be used to reduce the costs of upstream methods. In addition, $CO_2$ binding is possible with the method according to the invention, which significantly improves the environmental impact.

The invention claimed is:

1. A method for treating steel mill slag comprising the following steps:

A) providing the steel mill slag, which, when solidified, has iron(II) oxide (FeO) and, if solidified, has a fineness such that the steel mill slag has a specific surface area according to BET of 0.1 $m^2/g$ or more, B) treating the steel mill slag at a temperature of at least 600° C., while adding oxidising agents and auxiliary agents, a) wherein the oxidising agents oxidise at least a part of the iron(II) oxide (FeO) present to iron(III) oxide ($Fe_2O_3$) and/or iron(II,III) oxide ($Fe_3O_4$) and b) wherein the auxiliary agents form a bond at least with calcium from calcium-iron compound present and bound in the steel mill slag and b1) thereby release iron(III) oxide ($Fe_2O_3$) and/or iron(II,III) oxide ($Fe_3O_4$) and b2) further increase a proportion of 2 $CaO{\cdot}SiO_2$ (belite) and/or other calcium silicates in the treated steel mill slag, C) separating iron(III) oxide ($Fe_2O_3$) and iron(II,III) oxide ($Fe_3O_4$) out of the treated steel mill slag.

2. The method according to claim 1, wherein the method further includes:

D) further treating the steel mill slag after step B) in a reducing atmosphere by means of adding reducing agents to the treated steel mill slag to reduce iron(III) oxide ($Fe_2O_3$) to iron(II,III) oxide ($Fe_3O_4$).

3. The method according to claim 2, wherein step D) is carried out after step B) and before step C).

4. The method according to claim 1, wherein the treated steel mill slag is cooled, solidified and crushed before step C) so that the cooled, solidified and crushed steel mill slag has a specific surface area according to BET of 0.1 $m^2/g$ or more.

5. The method according to claim 1, wherein the separating in step C) is based on magnetic properties, density, and/or by means of flotation.

6. The method according to claim 1, wherein the method further includes:

E) further treating the steel mill slag after step B) with $CO_2$ to convert 2 $CaO{\cdot}SiO_2$ (belite) and/or other calcium silicates into $CaCO_3$ and $SiO_2$ and/or other reaction products.

7. The method according to claim 6, wherein step E) is carried out in an aqueous suspension of cooled, solidified and crushed steel mill slag and a gas, which contains the $CO_2$, is injected.

8. The method according to claim 6, wherein the method further includes, after step E):

F) separating by means of floatation $CaCO_3$-rich material from iron oxides in the treated steel mill slag.

9. The method according to claim 7, wherein the gas, which contains the $CO_2$, originates from steel production.

10. The method according to claim 8, wherein the method further includes:

feeding the $CaCO_3$-rich material into a steel or pig iron production process or cement production process for further utilization.

11. The method according claim 1, wherein the method further includes:

after step E), separating an $SiO_2$-rich material from iron oxides in the treated steel mill slag and feeding the $SiO_2$-rich material into a cement production process for further utilization.

12. The method according to claim 1, wherein the method further includes:

feeding the iron(III) oxide ($Fe_2O_3$) and/or the iron(II,III) oxide ($Fe_3O_4$) from step C) into a steel production process and/or blast furnace processes for further utilization.

13. The method according to claim 1, wherein a 2 $CaO{\cdot}SiO_2$ (belite)-rich material and/or a material which is rich in other calcium silicates is separated and/or recovered from the treated steel mill slag and fed into a cement production process for further utilization.

14. The method according to claim 1, wherein before step A), in a step 0), the steel mill slag is prepared to a desired particle size by means of grinding and/or granulation.

15. The method according to claim 14, wherein in step 0) or after step A) metallic iron (Fe) and/or iron(II,III) oxide ($Fe_3O_4$) are separated from the steel mill slag.

16. The method according to claim 1, wherein step B) is performed in normal atmospheric air comprising oxygen, and wherein the oxygen serves as at least one of the oxidising agents.

17. The method according to claim 1, wherein the oxidising agents comprise $H_2O_2$, ozone, $N_2O$, or oxygen.

18. The method according to claim 1, wherein the auxiliary agents comprise $SiO_2$.

19. The method according to claim 1, wherein the auxiliary agents comprise sandstone, quartzite, coal fly ash, sand, silica dust, pozzolana, and/or fired clay.

* * * * *